United States Patent [19]

Soulier

[11] 4,406,937

[45] Sep. 27, 1983

[54] MICROWAVE DEVICE FOR THE HEAT TREATMENT OF POWDERY OR GRANULAR MATERIALS

[76] Inventor: Joël Soulier, La Chaussee d'Ivry, Route de Pacy, 28260 Anet, France

[21] Appl. No.: 240,946

[22] Filed: Mar. 5, 1981

[30] Foreign Application Priority Data

Mar. 13, 1980 [FR] France ..... 80 05607

[51] Int. Cl.[3] ..... H05B 6/78

[52] U.S. Cl. ..... 219/10.55 A; 219/10.55 F; 219/10.55 D; 34/1

[58] Field of Search ..... 219/10.55 A, 10.55 R, 219/10.55 F, 10.55 D, 10.55 M; 34/1

[56] References Cited

U.S. PATENT DOCUMENTS 3,549,848 12/1970 Williams ..... 219/10.55 A
3,777,095 12/1973 Muranaka ..... 219/10.55 A

FOREIGN PATENT DOCUMENTS 1471131 1/1967 France .
2337734 8/1977 France .
1369677 10/1974 United Kingdom .

*Primary Examiner*—Bruce A. Reynolds
*Assistant Examiner*—Philip H. Leung
*Attorney, Agent, or Firm*—Oblon, Fisher, Spivak, McClelland & Maier

[57] ABSTRACT

A two part waveguide consists of a fixed part formed of a metal sleeve provided with metal dividing walls and a movable part formed by a helix positioned within the sleeve and rotatable sleeve about an axis coaxial with the axis of the cylindrical sleeve. A plurality of magnetrons are positioned on the outer surface of the sleeve. The sleeve includes two openings, one for admitting material to be treated and the other for discharging the material to be treated. The openings are dimensioned so that the microwaves cannot leave the waveguide.

13 Claims, 6 Drawing Figures

2a.
2b.
1
2b
3
4
6
7
9
10
11
14
15
18

MICROWAVE DEVICE FOR THE HEAT TREATMENT OF POWDERY OR GRANULAR MATERIALS

BACKGROUND OF THE INVENTION

The present invention relates to a novel device for the heat treatment of divided material and particularly of powdery or granular material.

Heat treatment by means of microwaves (M.O.) or ultrahigh frequency waves (UHF) having wavelengths between about 300 Megahertz and about 30 Gigahertz is becoming at present more and more widespread, particularly because of the ready availability of this energy, its good propagation in various atmospheres, its good regulation and its satisfactory control. The homogeneous heating throughout the whole of the mass of the product treated which it provides has furthermore allowed numerous applications of this form of energy, not only in the domestic but also in industrial fields. There existed however an important drawback, at least insofar as the industrial applications of UHF radiation are concerned: although the discontinuous or batch treatment of the different products and materials is as a whole satisfactory and presents no great problem, the same cannot be said for the continuous treatment of large quantities of materials, and particularly of materials in the divided state, such as grains, powders or similar. In fact, for this mass heat treatment to be economically profitable, very large quantities of material must be treated, and this without loss of energy, and robust and simple installations must also be available. None of the installations of the prior art complies with these basic requirements.

The use of multimode resonator cavities is excluded: on the one hand there is not enough energy density concentration and, on the other hand, very large volumes would have to be constructed, something which is difficult to achieve and economically unprofitable.

It is also economically unprofitable to provide a succession of resonator cavities connected to each other (as for example the construction of an enclosure forming a "tunnel" passing through the resonator cavities, as is recommended in French Pat. No. 2,428,369): there also occur considerable energy leaks due to the input and output system for the material.

The use of monomode and multimode wave-guides has also been recommended using not stationary waves but progressive waves. Thus coaxial devices have been constructed in which the materials to be treated are inside the wave-guide or else devices with emitting antennae, in which the materials to be treated receive the M.O. radiations.

Besides the fact that, in the devices of the prior art, the flow rate of the materials to be treated is limited, even with the installation of conveyor belts, there occur furthermore high energy losses for the material to be treated thus conveyed so the material is not in the maximum energy concentration zone. Numerous other attempts at constructing continuous M.O. energy applicators have been described for example:

1. A device using an endless screw (French Pat. No. 2,337,734),
2. A device using a rotating plate (U.S. Pat. No. 3,676,058), and still others.

But in all cases, the same handicap exists: insufficient flow rate, a too high loss in energy, prohibitive cost of installation.

SUMMARY OF THE INVENTION

The aim of the present invention is accordingly to provide a device which not only retains the monomode wave-guide - the most satisfactory device with the highest energy density - but also to provide a device which causes the material to be treated to advance continuously with a high, constant and adjustable flow rate, while maintaining it within a maximum energy field. One of the aims of the present invention is also to be able to use low-power energy sources, mass-produced and thus economically very interesting.

The present invention provides a device for the heat treatment of divided materials and particularly powdery or granular materials, by UHF radiation. It comprises in combination, a two-part wave-guide, a fixed part formed by a sleeve made from metal or from a similar conducting material, provided with metal separating walls perpendicular to said sleeve, and comprising in the free space between the separating walls a lining made from a nonpolar material, and a mobile part formed by a helix made from a conducting material rotating about an axis, or Archimedes screw, and whose pitch corresponds exactly to the distance which separates two successive dividing walls with which the sleeve is provided. A plurality of magnetrons are applied against the outer face of the sleeve, the distance between two successive magnetrons depending on the pitch of the helix and on the material to be treated. Two apertures, one for the admission, the other for the discharge of the material, are dimensioned so that the wave used cannot leave the wave-guide.

In accordance with the invention, the sleeve and the dividing walls perpendicular to the sleeve, i.e. the fixed part of the wave-guide, represent between $\frac{1}{4}$ and $\frac{1}{2}$ of the total height of the wave-guide.

In fact, if the fixed part of the wave-guide, i.e. the dividing walls and the lining which fills the space between the nonpolar dividing walls, would descend to the mid-height of the wave-guide, the material to be treated would certainly be within the maximum field of action, but the effective volume of the treated material would be reduced; if on the other hand the helix would touch the wall of the sleeve, i.e. if the fixed walls perpendicular to the sleeve were done away with, the volume of treated material would be maximum, but the energy loss would also be maximum, for the current flows of the wall itself would be cut, the optimum effect being obtained, in accordance with the invention, between $\frac{1}{4}$ and $\frac{1}{2}$ of the total height of the wave-guide.

According to an advantageous embodiment of the invention, and so as to avoid reflection of waves on the source, the width of the excitation device exceeds the pitch of the helix.

According to a particularly advantageous embodiment of the invention, the thickness of the helix, in particular in the vicinity of the fixed part of the wave-guide formed by the dividing walls, is calculated so that there is never communication between two excitation guides.

This embodiment of the invention, which allows in fact low-power and very cheap commercial magnetrons to be used, makes the device of the present invention particularly adapted to all heat treatments bringing into use considerable quantities of materials.

According to another embodiment, for the same reasons, the thickness of the fixed dividing walls perpendicular to the sleeve is also calculated so that there is no communication between two excitation guides.

In accordance with the invention, the device is provided with means for recovering and using the cooling air from the magnetrons in order to, if need be, remove the water vapor from the treated material.

In another embodiment of the invention, the heat treatment device is pressurized by means of an inert gas, such as nitrogen for example.

In accordance with the invention, the openings for admission and discharge of the materials are square-section tubes whose sides are at most equal to half the wavelength used for treating the material.

According to another embodiment of the invention, the openings for admission and discharge of materials are circular-section tubes, whose diameters do not allow propagation of the wave used for treating the material.

In accordance with the invention, it may be advantageous, in certain cases, especially when it is desired to increase or reduce the value of the UHF electric field, to have a variable-pitch Archimedes screw.

Since the positioning of the dividing walls perpendicular to the sleeve depends on the pitch of the helix, it is obvious that in the case where the helix forming the Archimedes screw has a variable pitch, the distance between these dividing walls is not uniform, but variable.

According to another advantageous embodiment of the invention, the thickness of the lining of the sleeve, which is made from nonpolar materials such as polyethylene or polystyrene, and is housed between the dividing walls, represents from $\frac{1}{4}$ to $\frac{1}{2}$ the total height of the wave-guide.

In accordance with the invention, the sleeve is formed from two half-sleeves joined together by two flanges.

Also in accordance with the invention, the edge of the helix which faces the dividing wall is beveled.

Apart from the preceding arrangements, the invention comprises further arrangements which will become evident from the following description.

The invention provides more particularly a novel device for the heat treatment of large quantities of divided materials, as well as the general devices and processes in which are included the devices in accordance with the present invention.

The invention will be better understood from the description which follows which refers to one embodiment of the device in accordance with the present invention.

It should of course be understood however that this embodiment described hereafter and shown in the accompanying drawings is given solely by way of illustration of the object of the invention, but forms in no way a limitation thereof.

DESCRIPTION OF THE DRAWINGS

FIG. 2*a* is a longitudinal section and FIG. 2*b* is a cross-section of this device;

FIG. 3*a* is a longitudinal section and FIG. 3*b* is a cross-section of this device.

DESCRIPTION OF THE PREFERRED EMBODIMENT

Figure 1:
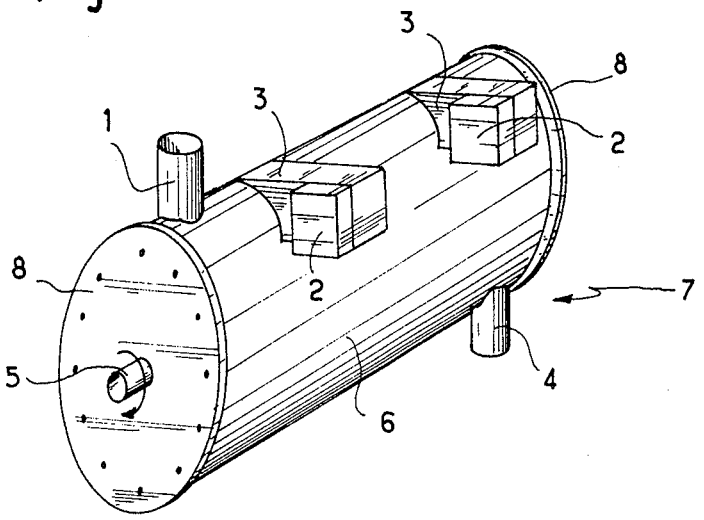
FIG. 1 is a diagrammatic view of the device, seen from outside.

The device according to the invention, such as shown in FIG. 1, comprises a tube 1 for admitting the divided material, a tube 4 for discharging the treated material, a sleeve 6 (inside which rotates the Archimedes screw driven by the drive shaft 5), magnetrons 2 and excitation guides 3. The device forms a module 7 which may be (by removing flange 8) joined to other modules so as to form, if so desired, and depending on the amount of material which it is desired to treat, longer or shorter wave-guides.

Figure 2:
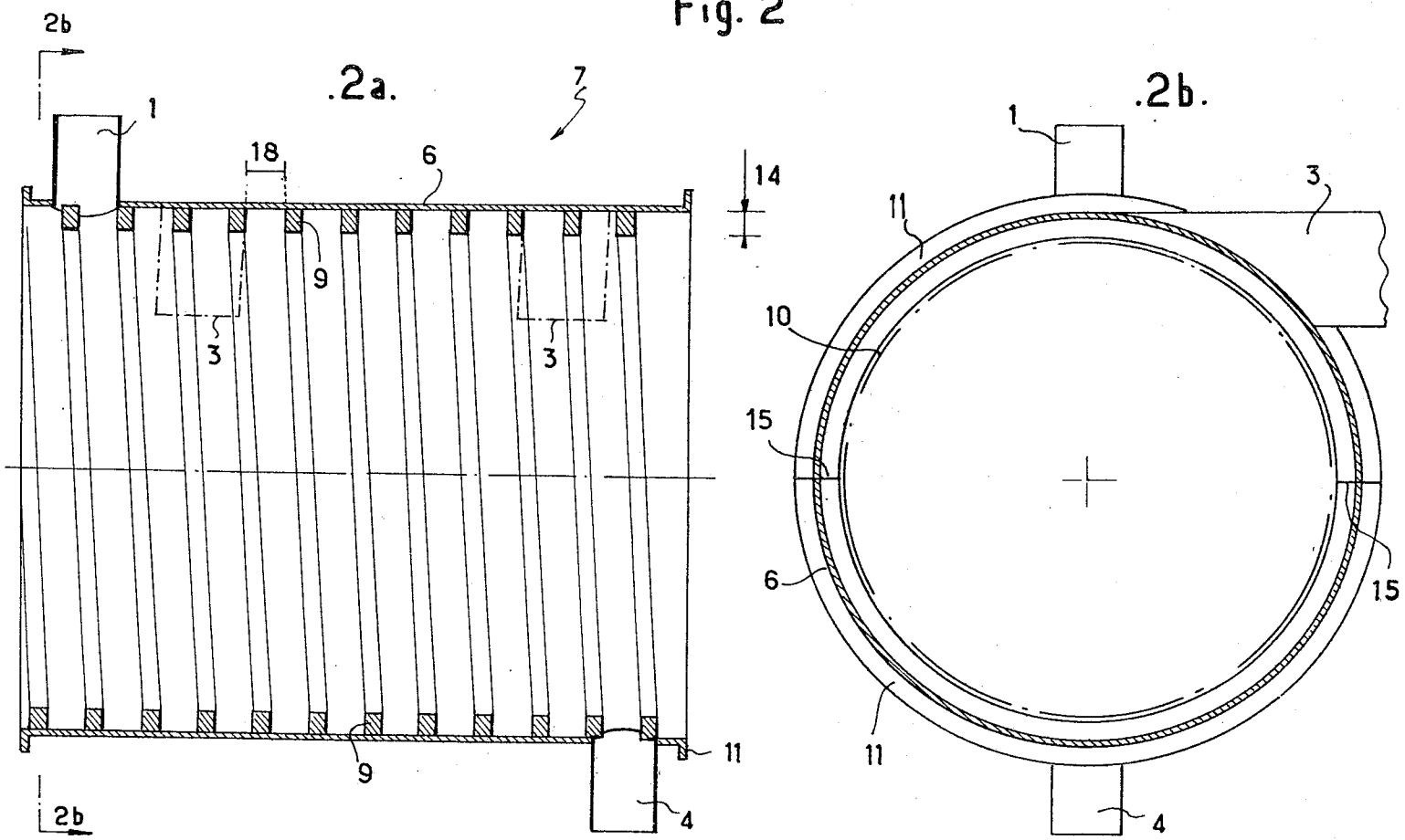
FIG. 2 shows diagrammatically the fixed part of the wave-guide.

The fixed part of this module 7 is shown in detail in FIG. 2 (FIG. 2*a* is a longitudinal section and FIG. 2*b* is a cross-section). There can clearly be seen therein the dividing walls 9 facing the turns 10 of the helix. For example, such a module 7 may measure 600 mm in length. It is provided with two magnetrons 2 and two excitation guides 3 of a width of 70 mm for example (between two successive magnetrons there is, for example, three spiral pitches 18 of a total length of 150 mm) the diameter of the tubes for admitting and discharging the material is 60 mm for example. The module is particularly adapted for microwaves of 2.45 GHz (the power of each of the magnetrons is 1 kW). The height 14 of the dividing walls 9 is 20 mm for example. The material to be treated is located between the turns 10 of the helix, in the lower part, near the drum-shaft 13. Knowing the minimum value of the loss factor $\epsilon''$ of the material to be treated, as well as its volume, the number of turns between two sources is determined so that all the energy emitted by one source is absorbed before the arrival of the energy from the next source.

Figure 3:
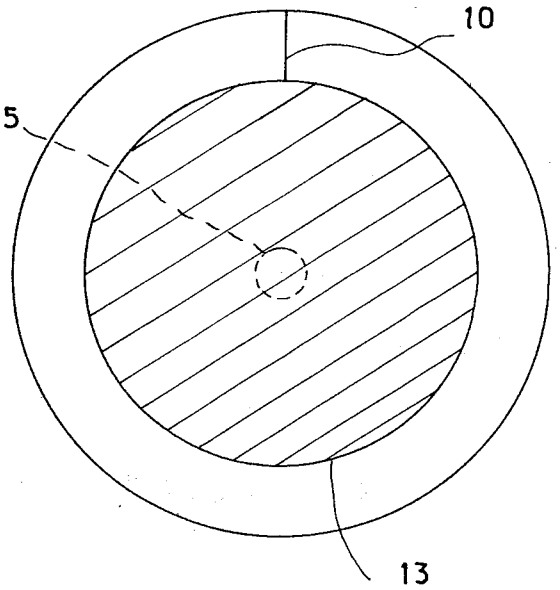
FIG. 3 shows diagrammatically the movable part of the wave-guide.
Figure 3:
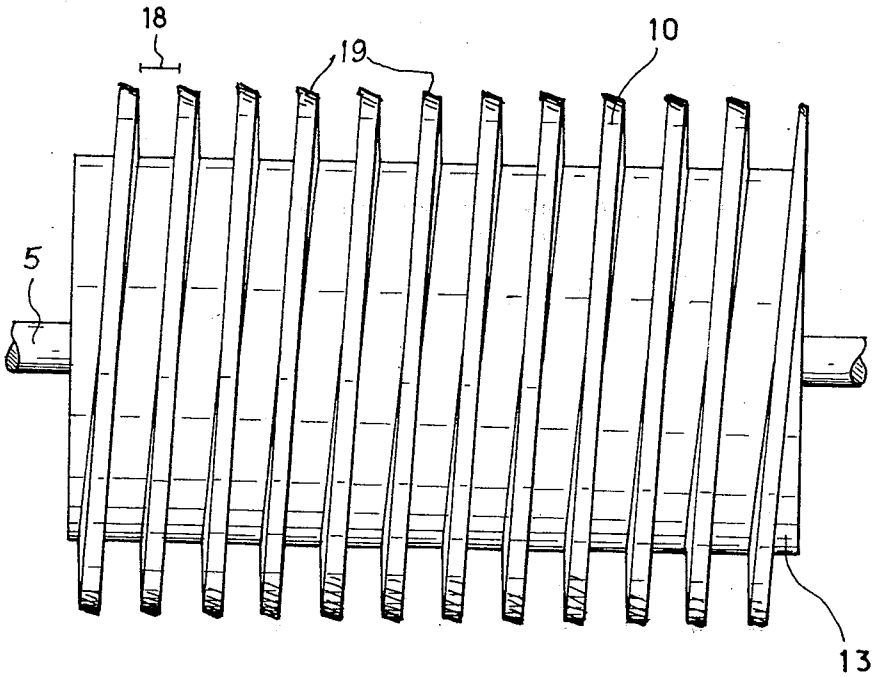

The movable part of this wave-guide is shown in FIG. 3 (FIG. 3*a* being a longitudinal section and FIG. 3*b* a cross-section). The total helix plus drum height is 440 mm, the helix alone measuring 120 mm, which gives a fixed part/total height ratio$=40/(120+40)=\frac{1}{4}$ for this embodiment.

The dimensions of this module allow effective filling of 4.8 1, or 90 kg of material per hour. In other words, by joining together, for example, ten of these modules end to end after removal of flanges 8, substantially a ton of material can be treated per hour, for an apparatus whose total length does not exceed 6 m.

The sleeve 6 may advantageously be formed by two half-sleeves 11, joined by flanges 15, to facilitate mounting of these devices.

Figure 4:
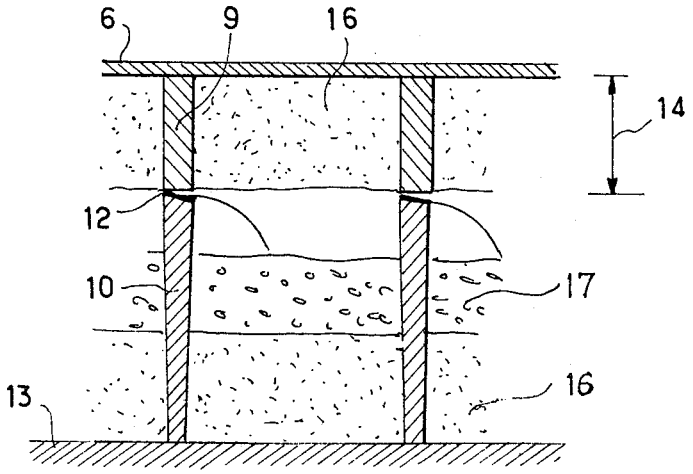
FIG. 4 shows the wave-guide delimited by two successive turns of the helix facing two dividing walls fixed onto the sleeve.

FIG. 4 shows a "section" of the wave-guide defined by sleeve 6, the two fixed dividing walls 9, the two turns 10 and the surface of the drum-shaft 13. A lining 16 made from nonpoplar material, for example from polystryene, fills the space between the two dividing walls 9. The divided material 17 being treated is in the lower part of the Archimedes screw above non-polar lining 16.

The thickness 12 of the turns 10 in the neighborhood of the dividing walls 9, is calculated so that there is never communication between two excitation guides. (It is 15 mm for the - nonlimiting - example described above).

The edge 19 of the helix which faces dividing wall 9 is beveled.

The width of the excitation device 3 applied against sleeve 6 is such that it exceeds the pitch of helix 18, so as to avoid reflection of the wave on the source.

The device in accordance with the present invention, described and shown in the drawings, may, if so desired, be pressurized by means of an inert gas - such as nitrogen for example. It may also comprise (not shown in the Figures) means for using the cooling air from the magnetrons 2 for discharging, if required, the water vapor for example released by the treated material.

It follows from the preceding description that, whatever the embodiments and modes of application adopted, a device is obtained for the heat treatment of divided materials, by means of microwaves, which presents, with respect to previously-known devices for the same purpose, important advantages, of which the following may in particular be cited:

1. The advantage of being able to treat large quantities of material continuously very economically and profitably with a minimum energy loss;
2. The advantage of obtaining installations which are simple, robust and easy to mount and maintain;
3. The advantage of being able to use low-power energy sources, which are mass-produced;

Another not inconsiderable advantage obtained by the device in accordance with the present invention is that because of the presence of the Archimedes screw, the material, while undergoing the heat treatment, is constantly mixed, which ensures perfect homogenization of the treated material.

As follows from what has gone before, the invention is in no way limited to those of the implementations, embodiments and modes of application thereof which have just been described more explicitly: it embraces, on the contrary, all variations thereof which may occur to the man skilled in the art, without departing from the scope or spirit of the present invention.

What is claimed as new and desired to be secured by letters patent of the United States is:

1. A device for the heat treatment of divided material by microwave radiation to create a progressive wave, said device comprising:

a cylindrical sleeve formed from an electrical conducting material;

metal dividing walls fixed to the interior surface of said sleeve and spaced from one another by a first distance, said walls extending substantially perpendicular to the axis of said sleeve;

a nonpolar lining positioned in said sleeve in spaces between said walls, said sleeve, said walls and said lining defining a fixed waveguide portion;

a movable waveguide portion comprised by a helix inside said sleeve and rotatable about an axis coaxial with the axis of said cylindrical sleeve, the pitch of said helix being equal to said first distance, whereby said divided material may be transported along the length of said sleeve;

a plurality of magnetrons positioned on the outer surface of said sleeve, the axial distance between two successive ones of said magnetrons being a function of said helix pitch;

a first opening in said sleeve for admitting said material;

a second opening in said sleeve for discharging said material, said first and second openings being dimensioned so that said microwaves cannot leave said sleeve via said openings.

2. The device of claim 1 wherein the radial height of said sleeve and walls constitutes between $\frac{1}{4}$ and $\frac{1}{2}$ of the combined radial height of said sleeve, said walls and said helix.

3. The device as claimed in claim 1, wherein the width of each of said magetrons exceeds the pitch of said helix.

4. The device as claimed in claim 1, wherein the thickness of said helix, in particular in the neighborhood of the fixed wave-guide portion formed by the dividing walls, is set so that there is never communication between microwaves emitted from two of said magnetrons.

5. The device as claimed in claim 1, wherein the thickness of said fixed dividing walls is set so that there is never communication between microwaves from two of said magnetrons.

6. The device of claim 1 wherein cooling devices associated with said magnetrons produce cooling air, said cooling device including means for selectively using said cooling air for removing water vapor released from said material during treatment.

7. The device as claimed in claim 1, wherein said heat treatment device is pressurized by means of an inert gas.

8. The device as claimed in claim 1, wherein said openings for admitting and discharging the material are square-section tubes whose sides are at most equal to half the wavelength of the microwaves used for the treatment of the material.

9. The device as claimed in claim 1, wherein said openings for admitting and discharging the material are circular-section tubes, whose diameters are sized so as to prevent propagation of the microwaves used for treating the material out of said sleeve.

10. The device as claimed in claim 1, wherein said helix is a variable-pitch screw.

11. The device as claimed in claim 1, werein the thickness of said lining of said sleeve represents from $\frac{1}{4}$ to $\frac{1}{2}$ of the total height of said sleeve, said walls and said helix.

12. The device as claimed in claim 1, wherein said sleeve is formed by two half-sleeves joined together by means of two flanges.

13. The device as claimed in claim 1, wherein the edge of said helix which faces said dividing walls is beveled.

* * * * *